US008234822B2

(12) United States Patent
Proctor et al.

(10) Patent No.: US 8,234,822 B2
(45) Date of Patent: Aug. 7, 2012

(54) MOBILE ENVIRONMENT CONTAINMENT UNIT

(75) Inventors: Kelly Lewis Proctor, Brunswick, GA (US); William Paul Oglesby, Brunswick, GA (US)

(73) Assignee: Environment of Care Resources Group LLC, Annapolis, MD (US)

( * ) Notice: Subject to any disclaimer, the term of this patent is extended or adjusted under 35 U.S.C. 154(b) by 0 days.

(21) Appl. No.: 12/555,505

(22) Filed: Sep. 8, 2009

(65) Prior Publication Data

US 2010/0058674 A1 Mar. 11, 2010

Related U.S. Application Data

(60) Provisional application No. 61/191,511, filed on Sep. 8, 2008.

(51) Int. Cl.

| | |
|---|---|
| ***E04B 1/12*** | (2006.01) |
| ***E04G 11/04*** | (2006.01) |
| ***E04H 1/00*** | (2006.01) |
| ***E04H 15/46*** | (2006.01) |
| ***E04H 15/42*** | (2006.01) |

(52) U.S. Cl. ..... 52/63; 52/2.17; 52/79.1; 135/139; 135/156

(58) Field of Classification Search ..... 52/79.1, 52/63, 2.17; 135/143–146, 156–158, 131, 135/139, 900

See application file for complete search history.

(56) References Cited

U.S. PATENT DOCUMENTS

| | | | | |
|---|---|---|---|---|
| 3,230,962 | A * | 1/1966 | Hoiness et al. | 135/148 |
| 3,766,844 | A * | 10/1973 | Donnelly et al. | 454/238 |
| 4,675,923 | A * | 6/1987 | Ashley | 4/599 |
| 4,682,448 | A * | 7/1987 | Healey | 52/63 |
| 4,711,563 | A | 12/1987 | Lass | 355/21 |
| 4,934,396 | A * | 6/1990 | Vitta | 135/139 |
| 5,062,871 | A * | 11/1991 | Lemon, III | 55/385.2 |
| RE33,810 | E * | 2/1992 | Strieter | 134/99.1 |
| 5,394,897 | A * | 3/1995 | Ritchey et al. | 135/124 |
| 5,558,112 | A * | 9/1996 | Strieter | 134/103.2 |
| 5,824,161 | A | 10/1998 | Atkinson | 134/6 |
| 6,321,823 | B1 * | 11/2001 | Whittemore | 160/368.1 |
| 6,383,242 | B1 * | 5/2002 | Rogers et al. | 55/385.2 |
| 7,134,444 | B2 * | 11/2006 | Mintie et al. | 135/131 |
| 7,188,636 | B1 * | 3/2007 | Kanne et al. | 135/142 |
| 7,189,349 | B2 * | 3/2007 | Karle | 422/28 |
| 7,406,978 | B2 * | 8/2008 | Mintie et al. | 135/131 |
| 2003/0133834 | A1 * | 7/2003 | Karle | 422/33 |

OTHER PUBLICATIONS

International Search Report for Application No. PCT/US2009/056260, dated Oct. 22, 2009.

Written Opinion for Application No. PCT/US2009/056260, dated Oct. 22, 2009, 4 pp.

* cited by examiner

*Primary Examiner* — Mark Wendell

(74) *Attorney, Agent, or Firm* — Kramer Levin Naftalis & Frankel LLP

(57) ABSTRACT

A mobile environmental containment unit has an upper frame with a sealing surface, a flexible, transparent impermeable envelope with an open top and one or more access openings that depends from the upper frame, and a lower frame that is supported by the envelope. The upper frame of the unit is supported by telescoping support members with the sealing surface of the upper frame and the open top of the envelope fitted against a portion of a ceiling which is accessible by a workman via the one or more access openings and the open top of the envelope.

24 Claims, 4 Drawing Sheets

MOBILE ENVIRONMENT CONTAINMENT UNIT

CROSS-REFERENCE TO RELATED APPLICATIONS

This application claims the benefit of priority to U.S. Provisional Application 61/191,511 entitled "Mobile Environmental Containment Cube" filed Sep. 8, 2008 and incorporated herein by this reference.

FIELD OF THE INVENTION

This invention pertains generally to mobile environmental containment units, and more particularly to a mobile unit for containment of particulate matter in an indoor environment so that occupants are protected from a risk of exposure.

BACKGROUND

The effects of inhaling particulate matter have been widely studied in humans and animals and include asthma, lung cancer, cardiovascular issues, and premature death. Researchers suggest that even short-term exposure at elevated concentrations could significantly contribute to heart disease. Exposure to particulate matter is hazardous, whether it occurs outdoors or inside a building. However, when indoor exposure occurs within a building occupied by persons receiving or seeking medical treatment, the consequences of exposure to particulate matter can be especially bad.

An example of an indoor source of particulate exposure is renovation and repair work, such as repair and/or replacement of ceiling tiles, light fixtures, and the like. When such work is performed, for example, by maintenance workers in a healthcare facility, such as a hospital, patients can be exposed to harmful particulates. Such patients, whose immune systems may already be weakened, are at high risk of additional illness from contaminants in the air, and the slightest amount of dust or particulate matter can cause serious health problems or even death. In addition, healthcare facility staff, as well as the workers who actually perform the renovation or repair work, are also at risk from inhaling harmful contaminates.

There is a present need for a mobile unit for containing and controlling sources of particulate matter, particularly within healthcare facilities such as hospitals and clinics where there is a compelling need to provide a controlled environment free of dust and particulate matter in order to protect patients, as well as visitors and staff from dust and particulate matter caused, for example, by removal and/or replacement of ceiling tiles and other items such as light fixtures and the like.

SUMMARY

In one aspect, embodiments of the invention provide a mobile environmental containment unit which controls the amount of dust and particulate matter caused, for example, by workmen performing work on a ceiling or removing a ceiling tile within a building.

In another aspect, embodiments of the invention provide a mobile environmental containment unit which controls the amount of dust and particulate matter by creating a negative pressure environment in which workmen can safely remove and install ceiling tile and do other work within a building where a controlled environment is necessary.

In a further aspect, embodiments of the invention provide a mobile environmental containment unit which protects everyone in the surrounding environment from dust, mold, rodent droppings, and other particulate matter that is common in ceilings and which is likely to be disturbed when ceiling tile is being removed or other work is being performed within a building, In still another aspect, embodiments of the invention provide a mobile environmental containment unit which protects patients and others in healthcare facilities, such as hospitals and clinics, from exposure to harmful particulates when maintenance workers make repairs.

In an additional aspect, embodiments of the invention provide a mobile environmental containment unit which greatly reduces the risk of exposure to particulate matter for maintenance workers when working in a ceiling of a building.

In another aspect, embodiments of the invention provide a mobile environmental containment unit that is light weight, e.g., weighing only about 20 pounds, and thus portable and that can be assembled and disassembled by one person in less than two minutes.

In still another aspect, embodiments of the invention provide a mobile environmental containment unit that allows workmen to perform work in ceilings above furnishings and fixtures, such as beds, toilets showers, cabinets and the like, and to remove of fixtures.

Embodiments of the invention propose a mobile environmental containment unit having an upper frame, a flexible, transparent impermeable envelope depending from the upper frame and having an open top and one or more access openings, and a lower frame supported by the envelope.

The upper frame for embodiments of the invention consists, for example, of opposing front and back upper frame members and opposing side upper frame members defining a substantially rectangular shaped upper frame. According to embodiments of the invention, the upper frame is provided with an upper sealing surface and has first and second supports extending respectfully from opposing upper side frame members and includes a telescoping support member which is detachable from the upper frame.

The envelope for embodiments of the invention is collapsible, and the upper and lower frames are spaced apart from one another in an uncollapsed condition of the envelope and moved toward one another in a collapsed condition of the envelope. According to embodiments of the invention, the envelope has a substantially parallelepipedal shape with opposing front and back panels, opposing side panels, and a bottom panel.

The envelope for embodiments of the invention can have access openings consisting, for example, of a pair of hand access openings formed in the front panel, which hand access openings can be configured as a sleeve that can also be elasticized for a snug fit.

Alternatively, the envelope for an anteroom aspect of embodiments of the invention can have an access opening consisting of an openable doorway formed in the front panel. The envelope for embodiments of the invention has an openable portion formed in the bottom panel, as well as a port formed in the bottom panel for attaching a negative air pressure source. According to embodiments of the invention, the port can be configured as a sleeve with a drawstring.

The lower frame for embodiments of the invention is supported within the envelope and likewise consists, for example, of opposing front and back lower frame members and opposing lower side frame members defining a substantially rectangular shaped lower frame.

Other features and aspects of the invention and embodiments thereof will be apparent from the following description and drawings.

BRIEF DESCRIPTION OF THE DRAWINGS

The foregoing and other advantages of the invention will be more fully understood with reference to the description of the best embodiment and the drawing wherein.

DETAILED DESCRIPTION

Figure 1:
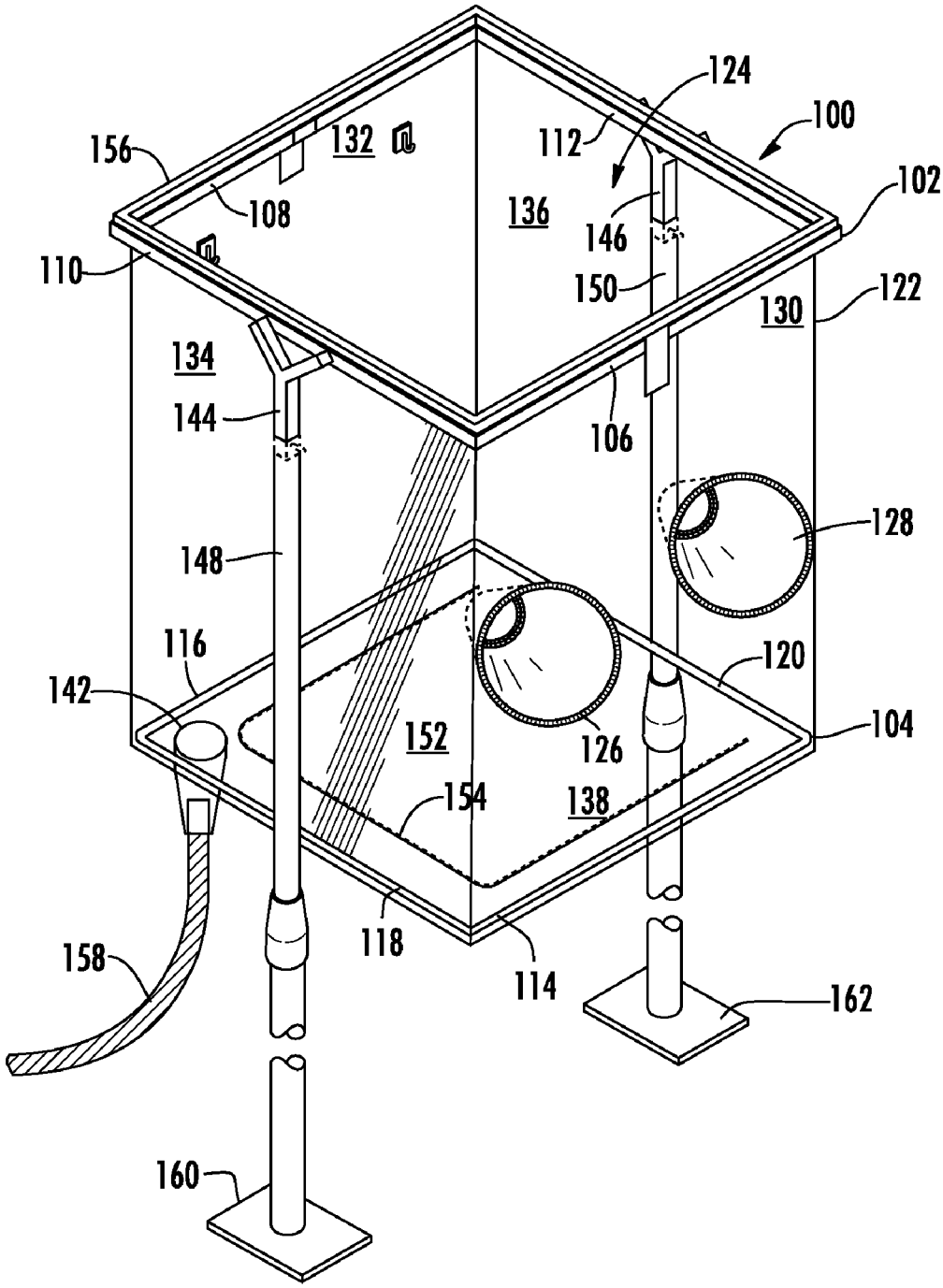
FIG. 1 shows an isometric view of an example of the mobile environmental containment apparatus for embodiments of the invention.

As required, detailed features and embodiments of the invention are disclosed herein. However, it is to be understood that the disclosed features and embodiments are merely exemplary of the invention that may be embodied in various and alternative forms. The figures are not necessarily to scale, and some features may be exaggerated or minimized to show details of particular components. Therefore, specific structural and functional details disclosed herein, and any particular combination of these details, are not to be interpreted as limiting, but merely as a basis for claims and as a representative basis for teaching one skilled in the art to variously employ the invention.

Referring now in detail to embodiments of the present invention, examples of which are illustrated in the accompanying drawings, each example is provided by way of explanation of the invention, not as a limitation of the invention. It will be apparent to those skilled in the art that various modifications and variations can be made in the present invention without departing from the scope or spirit of the invention. For example, features illustrated or described as part of one embodiment can be used on another embodiment to yield a still further embodiment. Thus, it is intended that the present invention covers such modifications and variations that come within the scope of the invention.

Embodiments of the present invention propose a mobile environmental containment apparatus which provides a safe effective tool for use, for example, in connection with changing ceiling tiles or working in a ceiling in an environment where particulate matter such as dust and fungi must be contained. The mobile environmental containment apparatus for embodiments of the invention is versatile in that it can be custom made to allow for all ceiling heights and ceiling tile sizes.

The mobile environmental containment apparatus for embodiments of the invention can also be custom sized to create an anteroom that acts as a barrier between persons particularly sensitive to exposure to particulate matter, such as seriously unhealthy patients, and staff and other patients who may be less likely to be harmed by such exposure. The pressure within the anteroom can be caused to become negative (i.e., less than ambient pressure) simply by adding a commercially available negative air machine or by using a likewise commercially available air scrubber.

The mobile environmental containment apparatus for embodiments of the invention provides protection to patients, as well as staff and workmen from dust and fungi particulates that may be disturbed, for example, when changing a ceiling tile or working in a ceiling or other opening that requires containment of dust or other particulates. While uniquely well suited for use in a healthcare environment in which patients as well as staff and workmen are exposed to harmful particulates found, for example, when a wet or damaged ceiling is repaired or replaced, the mobile environmental containment apparatus for embodiments of the invention is equally useful in virtually any industry or environment.

Figure 2:
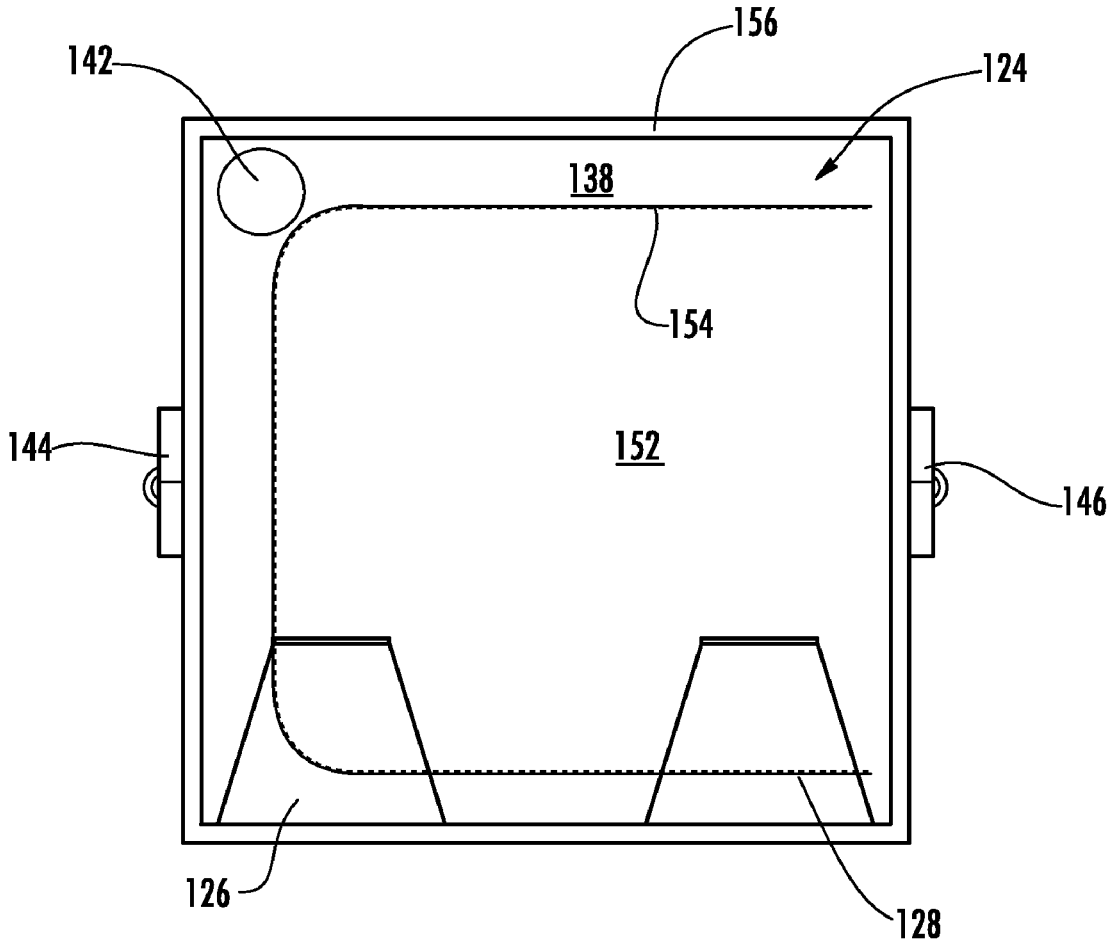
FIG. 2 shows a top view of an example of the mobile environmental containment apparatus for embodiments of the invention.
Figure 3:
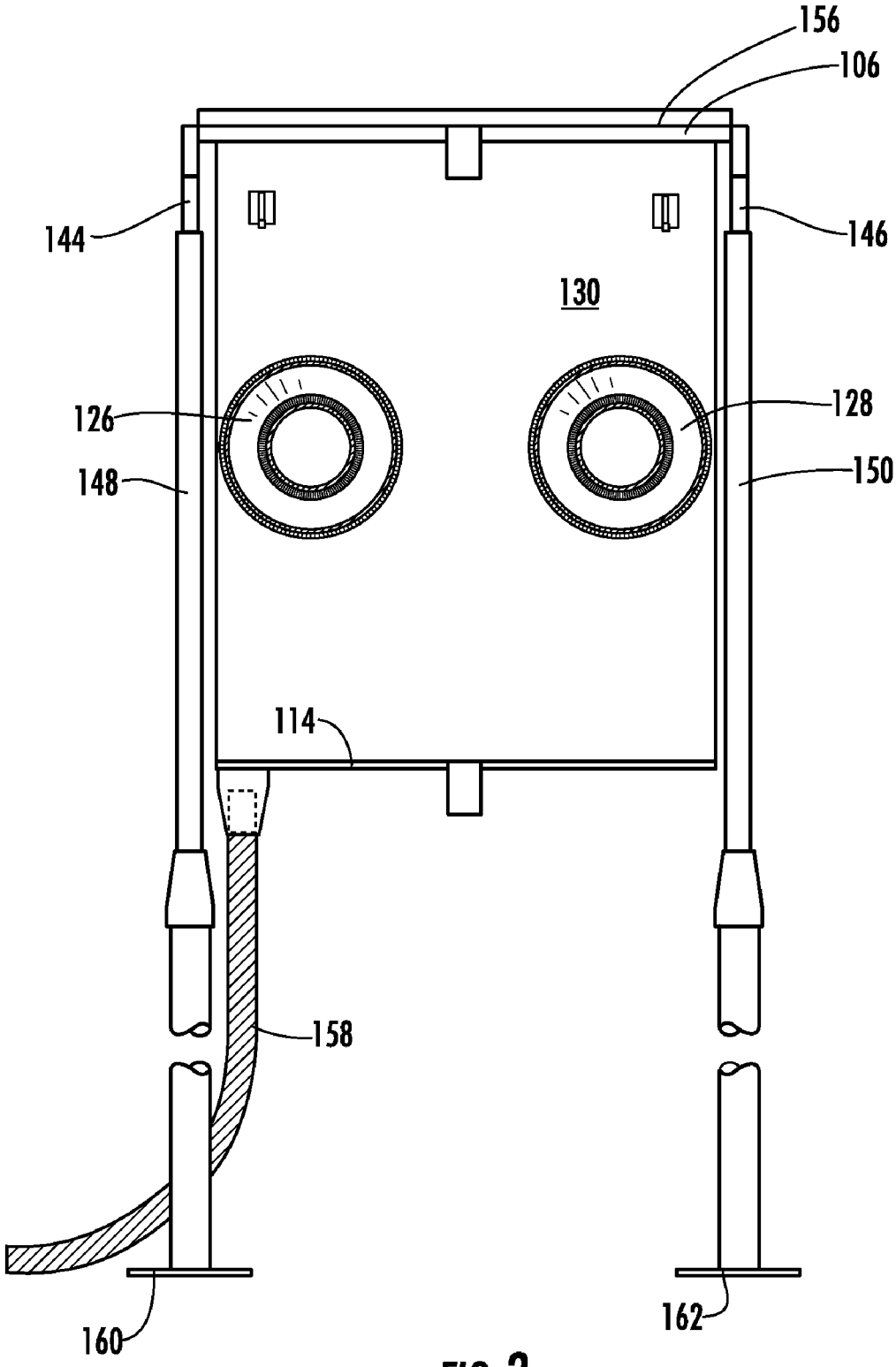
FIG. 3 shows a front view of an example of the mobile environmental containment apparatus for embodiments of the invention.

FIG. 1 shows an isometric view of an example of the mobile environmental containment apparatus for embodiments of the invention, and FIGS. 2 and 3 show top and front views respectively of the mobile environmental containment apparatus of FIG. 1.

Referring to FIGS. 1-3, the mobile environmental containment unit 100 for embodiments of the invention is made of lightweight, materials and comprises, for example, an upper frame 102 and a lower frame 104. The upper frame 102 defines, for example, a generally rectangular shape having opposing front and back upper frame members 106 and 108 and opposing side upper frame members 110 and 112. The lower frame 104 likewise defines, for example, a generally rectangular shape also having opposing front and back lower frame members 114 and 116 and opposing side lower frame members 118 and 120.

It is to be understood that the shape of the upper 102 and lower 104 frames is not limited to a rectangle but can be any other suitable regular or irregular geometric shape, Preferably, the frame members 106, 108, 110, 112, 114, 116, 118, and 120 are fabricated from a reasonably strong and relatively light weight material such one quarter inch diameter 16 gauge aluminum and/or stainless steel tubing, although other metals or a plastic with similar physical properties can likewise be used.

Referring further to FIGS. 1-3, an envelope 122 with an open top 124 and one or more access openings, such as hand access openings 126, 128, depends from the upper frame 102. The envelope 102 has a substantially parallelepipedal shape with opposing front and back panels 130 and 132, opposing side panels 134 and 136, and a bottom panel 138 that has a port 142 for attaching a negative air pressure source.

The envelope 122 is fabricated from a flexible, transparent impermeable material, such as clear 20 gauge or lighter polyvinyl chloride (PVC) film. However, it is to be understood that any other suitable flexible, transparent impermeable material can be employed as well. The hand access openings 126, 128 are configured, for example, as sleeves made of a strong, flexible, lightweight material such as rip-stop fabric and elastic or other suitable material.

Referring again to FIGS. 1-3, to raise and lower the mobile environmental containment unit 100 for embodiments of the invention, the upper frame 102 is provided with first and second supports 144, 146 to which first and second lockable, telescoping poles or support members 148 and 150 are removably connectible. Telescoping poles or support members 148 and 150 are supported on respective foot plates 160 and 162, which in turn rest on a supporting surface, such as a floor. Further, the bottom panel 138 of the envelope 122 can be provided with an openable portion 152 with a zipper 154 for additional access to the interior of the envelope 122. Likewise, one or more of the front and back panels 130 and 132, opposing side panels 134 and 136 can be provided with a zippered access opening.

As previously noted, the envelope 122 has an open top 124 and depends from the upper frame 102 which is a main support for the mobile environmental containment unit 100 for embodiments of the invention when deployed, for example, against a ceiling. Additionally, the upper frame 102 is provided with a sealing surface 156, such as a one-eighth inch to one-quarter inch foam pad, to provide a tight, secure fit to the ceiling. To create a negative pressure environment and control particulate discharge, a negative air pressure source 158, such as a HEPA vacuum hose is connected to the port 142 formed in the bottom panel 138.

The upper frame 102 of the mobile environmental containment unit 100 for embodiments of the invention can comprise a substantially square shape about two feet by two feet made, for example, from four pieces of metal stock, each slightly less than two feet long, and welded together into a square as shown in FIG. 1. The supports 144, 146 on the upper frame 102 can each comprise a general Y shape, as shown FIG. 1, made for example by welding together three pieces of metal stock, each about three inches long into the Y shape. The supports 144, 146 are preferably secured to the upper frame 102 by welding one on each of the opposing side upper frame members 110, 112 as shown in FIG. 1.

The envelope 122 for embodiments of the invention can be configured, for example, as a cube, albeit with an open top 124, about two feet on each side, made from 20 gauge or less PVC as illustrated in FIG. 1. Thus, the opposing front and back panels 130 and 132, opposing side panels 134 and 136, and bottom panel 138 can each comprise an approximately four-foot square panel of PVC which can be glued and stitched together, overlapping the upper and lower frames 102 and 104, to create a open top box-like shape. A zipper 154 can then be added to the bottom panel 138 to allow additional access to the inside of the mobile environmental containment unit 100 for embodiments of the invention as shown in FIGS. 1 and 2.

In order to accommodate the hand access openings 126, 128, two holes, each approximately eight inches in diameter, can be formed in one of the opposing front and back panels 130 and 132 or opposing side panels 134 and 136 of the envelope 122, and strong, flexible, lightweight material, such as rip-stop fabric, can be stitched around the holes and an elastic material installed to form a tight fit around a workman's arms when extended into the access openings 126, 128. To form the port 142 for attaching the negative air pressure source, a hole approximately two inches in diameter can be formed in the bottom panel 138 of the envelope 122, and material such as the rip-stop fabric can be similarly stitched around the hole to receive a vacuum hose 158, such as a HEPA vacuum hose. A draw string can be installed at the end of the rip-stop fabric to secure the received vacuum hose 158.

To deploy the mobile environmental containment unit 100 for embodiments of the invention, the telescoping support poles or members 148, 150 respectively are connected to the supports 144, 146 for moving the unit 100 vertically up and down as shown FIGS. 1 and 3 to engage and disengage from the ceiling. The telescoping support poles or members 148, 150 can be fabricated of relatively strong, lightweight material, such as aluminum or steel or any other type of metal or plastic material with suitable physical properties.

The mobile environmental containment unit 100 for embodiments of the invention can be stored in a collapsed state of the envelope 122 in which the upper and lower frames 102, 104 are disposed in close proximity to each other. In deploying the unit 100, the unit is removed, for example, from a carrying case and a slight upward pulling force is exerted on the upper frame 102 to move the upper frame 102 away from the lower frame 104, thereby expanding the collapsed PVC envelope 122.

Thereafter, one of the telescoping support poles or members 148 or 150 can be connected to one of the supports 144 or 146, and the telescoping support member 148 or 150 so connected can be extended until the upper frame 102 touches the ceiling. Once the upper frame 102 touches the ceiling, the connected telescoping support member 148 or 150 can be locked into place and the other one of the telescoping support poles or members 148 or 150 can be installed in the same manner.

Referring to FIGS. 1 and 2, the openable portion 152 of the bottom panel 138 of the envelope 122 can be unzipped and opened, for example, to install a collection bag, such as a commercial trash bag, and any other materials and tools needed to perform work on the ceiling and then closed and re-zipped. In order to create a negative pressure environment inside the envelope 122, the hose 158 of a HEPA vacuum can be connected to the vacuum or negative pressure port 142 of the envelope 122.

Access to the deployed unit 100 is by ladder, and gloves should be employed by a workman before inserting his or her hands into the hand access openings 126, 128 of the envelope 122, for example, to begin removing ceiling tile or performing similar types of work that must be contained. A workman can reach with his or her arms into the hand access openings 126, 128, for example, to lift out ceiling tiles or cut holes in the ceiling accessible via the open top 124 of the envelope 122, and the removed (e.g., stained or damaged) ceiling tiles or other contaminated materials can be placed inside the collection bag.

Once the collection bag is filled, or the task is completed, the collection bag can be tied off and the workman can remove his or her arms from the hand access openings 126, 128. The openable portion 152 of the bottom panel 138 of the envelope 122 can then be unzipped and opened, for example, to remove the collection bag and, for example, to place a replacement ceiling tile inside the envelope 122, whereupon the openable portion 152 can closed and re-zipped. The workman can then reach with his or her arms back into the hand access openings 126, 128 of the envelope 122 and install the new ceiling tile via the open top 124 of the envelope 122. Once the work is completed the unit 100 can be disassembled in a reverse manner to which it was installed.

Figure 4:
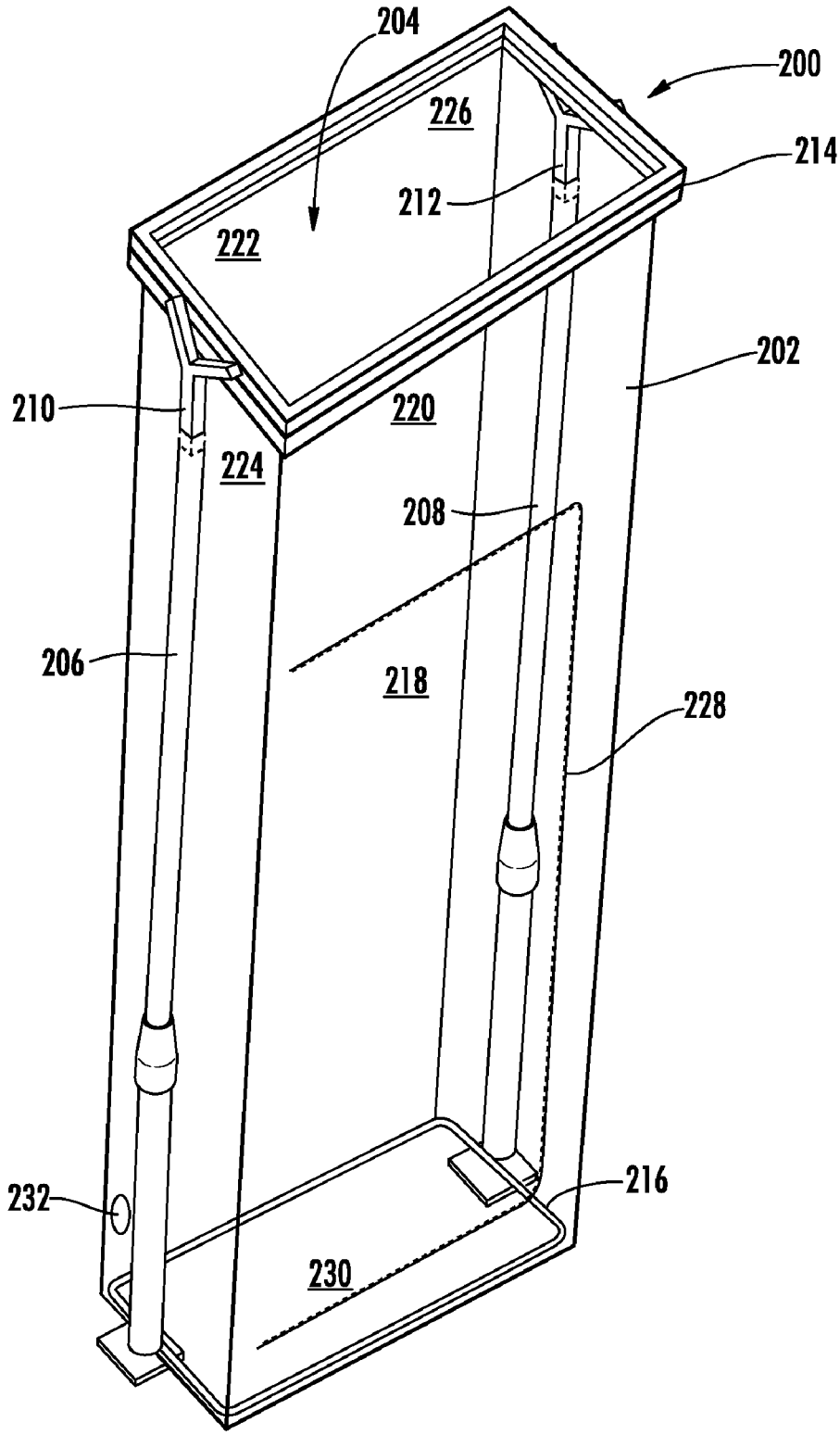
FIG. 4 shows an isometric view of an example of an anteroom aspect of the mobile environmental containment apparatus for embodiments of the invention.

FIG. 4 shows an isometric view of an example of an anteroom aspect of the mobile environmental containment apparatus for embodiments of the invention. Referring to FIG. 4, the anteroom dust barrier unit 200 for embodiments of the invention employs an envelope 202 with an open top 204 and functions in similar fashion to the smaller unit 100 described above, including telescoping support poles or members 206 and 208 that are connected to the supports 210 and 212, but is larger in size. When deployed, the envelope 202 extends or drapes from an upper frame 214 at ceiling level down to a lower frame 216 at floor level. If needed for support, additional telescoping support poles or members may be employed.

The anteroom aspect unit 200 can serve as a dust barrier between construction sites while construction is in progress or can be used as a clean room to allow for a separation between an ill patient and staff or other patients. Embodiments of the anteroom aspect unit 200 can be used in areas with ceilings up to 10 feet, although other embodiments may be configured for even higher ceilings. The envelope 202 of the anteroom aspect unit 200 can have an access opening 218 in a front 220, back 222 or one of the side panels 224, 226 of the envelope 202 that is configured as a door with a zipper 228 to allow staff to enter the inside of the envelope 202. The larger anteroom aspect unit 200 can be fabricated from the same materials as the smaller unit 100 and functions in substantially the same manner, including for example the provision of a bottom panel 230 and a port 232 to receive a vacuum hose.

The mobile environmental containment unit for embodiments of the invention can be manufactured an any number of different sizes and shapes to meet the requirements of each job. Regardless of the shape or size of the containment unit, its working principals remain the same, e.g., flexible, transparent impermeable plastic panels that create a separate environment within which to work, telescoping support poles or members that allow adjustment of the height and provide stability of the envelope, a tight seal to the ceiling (and floor in some designs), openings in the plastic panels configured as hand access openings and a vacuum hose port, and a zipper-equipped openable portion of the bottom panel for access.

Embodiments of the invention provide numerous advantages, such as light weight portability, ease of use, telescoping pole technology, and versatility, and an ability to work around or above fixed objects. While embodiments of the invention provide protection to patients and staff against harmful particulates and dust, embodiments of the invention also protect workmen in the performance of work that may cause or contribute to such harmful particulates and dust, for example, by keeping workmen on the outside of the containment unit for embodiments of the invention where they are also protected.

Various embodiments of the present invention have now been generally described in a non-limiting manner. It will be appreciated that these examples are merely illustrative of the present invention, which is defined by the following claims. Numerous variations, adaptations, and modifications will be apparent to those of ordinary skill in the art without departing from the spirit and scope of the present invention.

What is claimed is:

1. A mobile environmental containment unit, comprising:
an upper frame having an open top;
a first and second support extending from said upper frame, the first and second support each attached to the upper frame by a plurality of attachment portions;
a flexible, transparent impermeable envelope depending from the upper frame and having an open top and at least one access opening; and
a lower frame supported by the envelope, said upper frame and flexible, transparent impermeable envelope together defining a top opening in the mobile environmental containment unit, wherein each of the first and second supports is attached to a flat foot plate, each flat foot plate is at least three times the cross-section of the support the foot plate is attached to and increases contact surface with the ground while the mobile environmental containment unit is in use, increasing the stability of the mobile environmental containment unit.

2. A mobile environmental containment unit, comprising:
an upper frame having an open top;
a first and second support extending from said upper frame, the first and second support each attached to the upper frame by a plurality of attachment portions;
a flexible, transparent impermeable envelope depending from the upper frame and having an open top and at least one access opening; and
a lower frame supported by the envelope, said upper frame and flexible, transparent impermeable envelope together defining a top opening in the mobile environmental containment unit, wherein the plurality of attachment portions include a first and second attachment portion, and wherein the first and second attachment portion each extend from a common point relative to the respective support portion and form a v-shape.

3. A mobile environmental containment unit, comprising:
an upper frame having an open top;
a first and second support extending from said upper frame, the first and second support each attached to the upper frame by a plurality of attachment portions;
a flexible, transparent impermeable envelope depending from the upper frame and having an open top and at least one access opening; and
a lower frame supported by the envelope, said upper frame and flexible, transparent impermeable envelope together defining a top opening in the mobile environmental containment unit, wherein the plurality of attachment portions include a first and second attachment portion, and wherein the first and second attachment portion each extend from a common point relative to the respective support portion and form a v-shape, wherein the first and second attachment portion are separated when attached to the upper frame.

4. A mobile environmental containment unit, comprising:
an upper frame having an open top;
a first and second support extending from said upper frame, the first and second support each attached to the upper frame by a first and second attachment portion extending from a common point relative to the respective support portion forming a v-shape and separated where attached to the upper frame;
a flexible, transparent impermeable envelope depending from the upper frame and having an open top and at least one access opening; and
a lower frame supported by the envelope, said upper frame and flexible, transparent impermeable envelope together defining a top opening in the mobile environmental containment unit.

5. The mobile environmental containment unit of claim 4, wherein the upper frame further comprises opposing front and back upper frame members and opposing side upper frame members defining a substantially rectangular shaped upper frame.

6. The mobile environmental containment unit of claim 5, wherein the first and second supports extend respectfully from opposing upper side frame members.

7. The mobile environmental containment unit of claim 6, wherein each of the first and second supports further comprises a telescoping support member.

8. The mobile environmental containment unit of claim 7, wherein each of the telescoping support members is detachable from the upper frame.

9. The mobile environmental containment unit of claim 4, wherein the upper frame further comprises an upper sealing surface.

10. The mobile environmental containment unit of claim 4, wherein the envelope further comprises a collapsible envelope.

11. The mobile environmental containment unit of claim 10, wherein the upper and lower frames are spaced apart from one another in an uncollapsed condition of the envelope and moved toward one another in a collapsed condition of the envelope.

12. The mobile environmental containment unit of claim 4, wherein the envelope is a substantially parallelepipedal shaped envelope.

13. The mobile environmental containment unit of claim 12, wherein the parallelepipedal shaped envelope further comprises opposing front and back panels, opposing side panels, and a bottom panel.

14. The mobile environmental containment unit of claim 13, wherein the at least one access opening further comprises a pair of hand access openings formed in the front panel.

15. The mobile environmental containment unit of claim 14, wherein each hand access opening of the pair of hand access openings further comprises a sleeve.

16. The mobile environmental containment unit of claim 15, wherein each sleeve is elasticized.

17. The mobile environmental containment unit of claim 13, wherein the at least one access opening further comprises an openable doorway formed in the front panel.

18. The mobile environmental containment unit of claim 13, further comprising an openable portion formed in the bottom panel.

19. The mobile environmental containment unit of claim 13, further comprising a port formed in the bottom panel for attaching a negative air pressure source.

20. The mobile environmental containment unit of claim 19, wherein the port further comprises a sleeve.

21. The mobile environmental containment unit of claim 20, wherein the sleeve further comprises a drawstring.

22. The mobile environmental containment unit of claim 4, wherein the lower frame is supported within the envelope.

23. The mobile environmental containment unit of claim 4, wherein the lower frame further comprises opposing front and back lower frame members and opposing lower side frame members defining a substantially rectangular shaped lower frame.

24. The mobile environmental containment unit of claim 4, wherein the plurality of attachment portions include a first and second attachment portion, wherein the first and second attachment portion on each support are separated when attached to the upper frame.

* * * * *